United States Patent [19]

Deffner

[11] 4,035,941

[45] July 19, 1977

[54] AUDIO-VISUAL DISPLAY DEVICE

[75] Inventor: John F. Deffner, Lisle, Ill.

[73] Assignee: Visual Marketing Incorporated, Chicago, Ill.

[21] Appl. No.: 635,277

[22] Filed: Nov. 26, 1975

[51] Int. Cl.[2] ..... G09F 13/12

[52] U.S. Cl. ..... 40/219; 40/132 D; 40/28.1

[58] Field of Search ..... 40/28.1, 28.2, 28.3, 40/219, 132 D, 52

[56] References Cited

U.S. PATENT DOCUMENTS

| | | | |
|---|---|---|---|
| 596,672 | 1/1898 | Wirth | 40/219 |
| 728,063 | 5/1903 | Wilson | 40/219 X |
| 2,791,417 | 5/1957 | Daroff | 40/219 X |
| 3,088,996 | 5/1963 | Carter | 40/28.1 |
| 3,304,637 | 2/1967 | Tyndale | 40/28.1 |

FOREIGN PATENT DOCUMENTS

| | | | |
|---|---|---|---|
| 320,499 | 10/1929 | United Kingdom | 40/28.1 |
| 459,136 | 12/1936 | United Kingdom | 40/28.1 |

*Primary Examiner*—John F. Pitrelli
*Assistant Examiner*—Wenceslao J. Contreras
*Attorney, Agent, or Firm*—Hume, Clement, Brinks, Willian & Olds, Ltd.

[57] ABSTRACT

An audio-visual display device which sequentially displays and discusses pictorial representations of merchandise and thereafter mirrors actual merchandise is comprised of a display enclosure, audio apparatus and timer apparatus. The display enclosure has a plurality of compartments each provided with separate illumination apparatus therein. At least one side of each compartment has a one-way mirror which enables a consumer to see pictorial representations of merchandise affixed to the inside of the one-way mirror when the illumination apparatus has been actuated and to see an image of the consumer in the one-way mirror when the illumination apparatus is not actuated. The audio apparatus provides an oral description of pictorial representations of merchandise and actual merchandise. The timer apparatus sequentially regulates the illumination apparatus in each compartment and activates the audio apparatus to enable the consumer to view merchandise in pictorial form, to hear audio descriptions of the merchandise in pictorial form and to observe how actual merchandise looks in a mirror.

9 Claims, 3 Drawing Figures

AUDIO-VISUAL DISPLAY DEVICE

This invention relates to a display device. More particularly, the invention relates to a display device which sequentially displays and discusses merchandise and provides a mirror at the end of the audio-visual cycle by which a consumer may view how the merchandise would look in use.

Merchandising apparatus which combine display and audio mediums are known in the prior art. For example, British Pat. No. 459,136 discloses a display device having a plurality of compartments associated with individual illumination apparatus. As each compartment is illuminated, a sound recording device reproduces descriptive material in conjunction with the merchandise displayed in the compartment. In U.S. Pat. No. 3,088,966 there is disclosed a display device wherein a series of individual pictures are displayed with simultaneously coordinated audio messages for each picture.

Previously known display devices perform two functions. First, such devices provide a system wherein the merchandise is visually displayed. Second, as the merchandise is visually displayed, there is accompanying audio material which touts the merchandise. Upon completion of the visual and audio presentation, the prior art devices cease as an effective merchandising device and often fail to retain the attention of the consumer for a significant period of time.

It is an object of this invention to provide an audio-visual display device which sequentially displays and discusses the merchandise and which enables the consumer to visualize how the merchandise would look in use after the visual and audio presentations are completed.

It is another object of this invention to provide an audio-visual display device having an integrated mirror in which the consumer, at the end of the audio-visual cycle, may view how the merchandise would look in use.

It is still another object of this invention to provide an audio-visual display device which gives the consumer a pictorial and audio representation of the merchandise and provides at the end of the pictorial and audio representation a medium for viewing the merchandise as it would look in use.

According to the present invention, there is provided an audio-visual display device having a display enclosure, audio apparatus and timer apparatus. The display enclosure encompasses a plurality of compartments each having illumination apparatus therein. Forming a side of each compartment is a one-way mirror which enables the consumer to see pictorial representations of merchandise affixed to the inside of the transparent mirror when the illumination apparatus has been actuated and to see the image of the consumer in the transparent mirror when the illumination apparatus is not actuated. The transparent mirror has the characteristic of reflecting visible light radiation on one side when not illuminated on the opposite side from which the radiation originates and transmitting visible light radiation therethrough when illuminated on the opposite side from which the radiation originates. An example of another material which could be utilized in the present invention is a metallized plastic material. In this application it should be understood that the phrase "transparent mirror" encompasses all materials which have the characteristics described above.

The audio apparatus is a system which reproduces recorded audio presentations of information concerning the pictorial and actual merchandise. The audio apparatus must be capable of repeating the information so as to enable the display device to be as automated as possible. An endless loop tape system would provide such an automated system. An example of audio apparatus which would be sufficient is a tape cassette player.

The timer apparatus regulates the sequential activation of the illumination means in each of the compartments and the activation of the audio apparatus.

The audio-visual display device operates in the following manner. At the beginning of a cycle of operation the display enclosure is not illuminated so as to permit a consumer viewing the display enclosure to see the consumer's image in the transparent mirror. Upon simultaneous activation of illumination apparatus in a first compartment and the audio apparatus as regulated by the timer apparatus, the display device begins to describe merchandise displayed in pictorial form affixed to the inside of the transparent mirror forming a side of the first compartment. Upon completion of the audio description of the first compartment, activation of illumination apparatus in a second compartment occurs and the display device describes the merchandise displayed in pictorial form affixed to the inside of the transparent mirror forming a side of the second compartment. When all of the compartments have been illuminated and the merchandise in pictorial form therein described, the oral descriptions will cease and the illuminated apparatus will be turned off. At this point, the display enclosure will again permit the consumer viewing the display enclosure to see his image in the transparent mirror. The consumer may take merchandise hanging on a clothing rack adjacent to and supporting the display enclosure and view in the transparent mirror how the merchandise looks.

The invention will be better understood by reference to the drawings.

Figure 1:
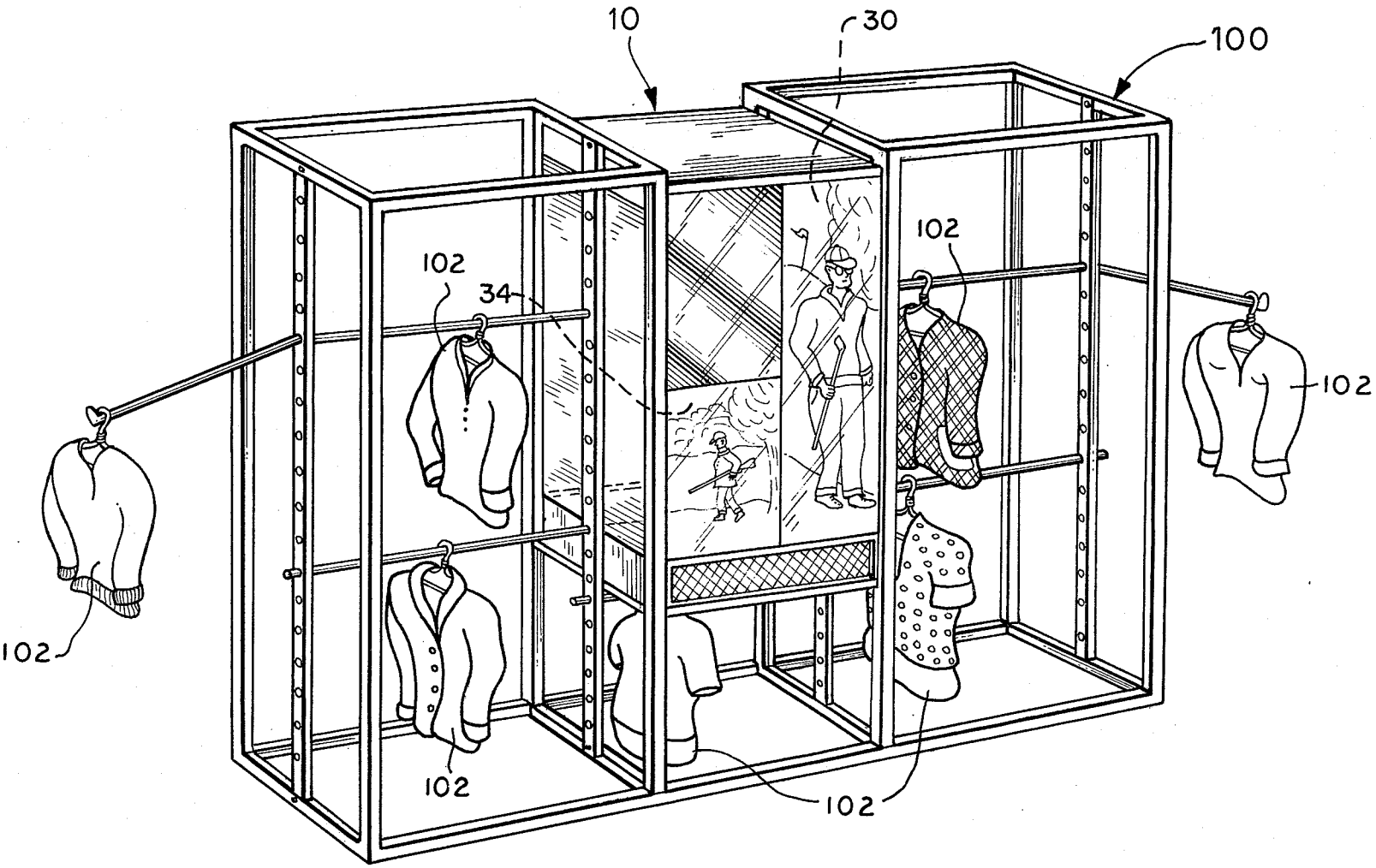
FIG. 1 is a perspective view of the combination of the display device of the present invention and a rack for displaying clothing.

Referring now to FIG. 1, there is illustrated a display device of the present invention indicated generally by reference numeral 10 in combination with a clothing rack, indicated generally by reference numeral 100. In this combination, the display device 10 will pictorially display and orally describe clothing merchandise 102 hanging on the adjacent clothing rack 100. The clothing merchandise 102 is the merchandise being pictorially displayed in the pictures 30 and 34 and described by the display device 10. Having the clothing merchandise 102 adjacent to the display device 10 enhances the chance of sale by its placement in close proximity to the pictures 30 and 34 which are seen in and described by the display device 10.

The clothing rack 100 supports the display device 10 and may be made of any suitable, sturdy material, such as a metal, plastic, or the like. Thus, the main purpose of the clothing rack 100 is for supporting the display device 10 along with providing a place for hanging the clothing merchandise 102 in close proximity to the display device 10. In this manner the display device 10 will enhance the chance of sale of the clothing merchandise 102 being pictorially displayed and orally described by the display device 10.

Figure 2:
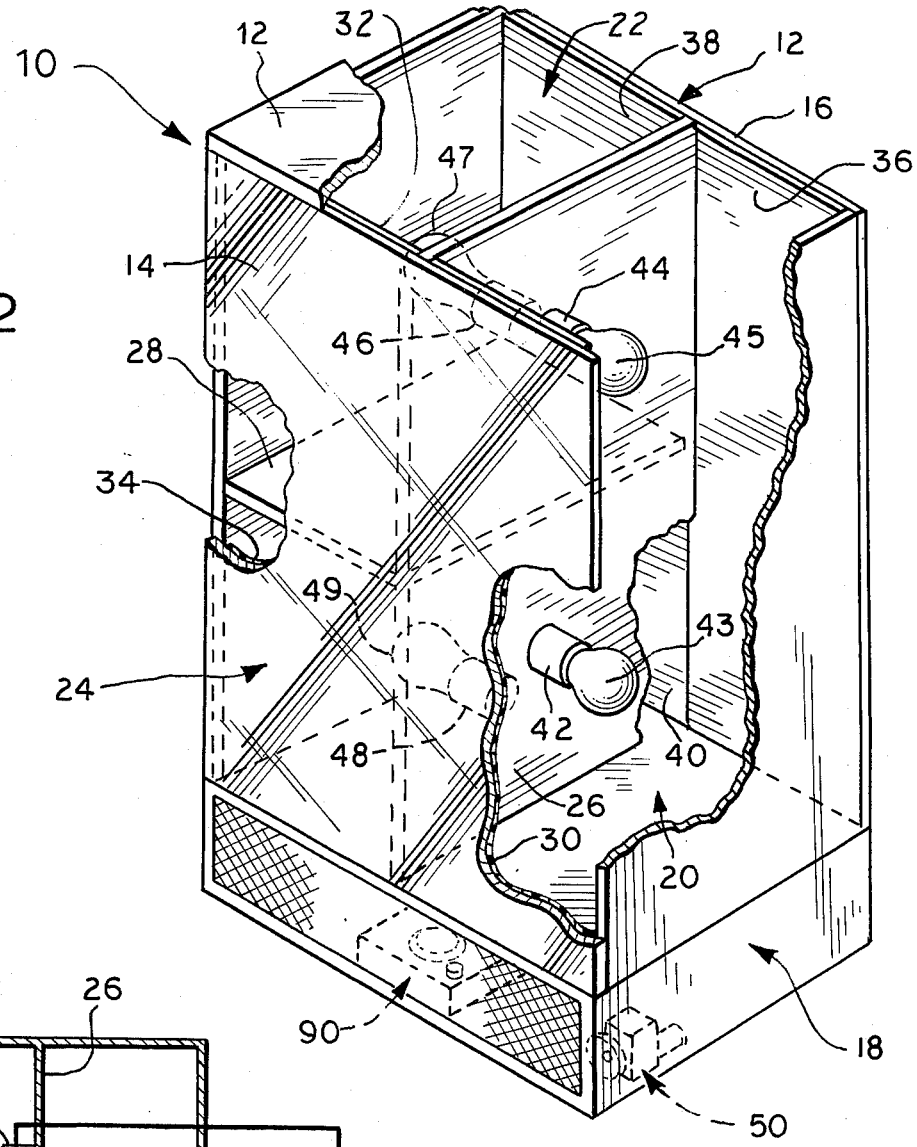
FIG. 2 is a partially cut-away perspective view of the display device of FIG. 1.

Referring now to FIG. 2, the display device 10 of the present invention will be described in greater detail. The display device 10 comprises a display enclosure 12, a timer apparatus 50, and an audio apparatus 90. These elements interact in a predetermined relationship regulated by the timer apparatus 50 to systematically display a pictorial representation of merchandise within the display enclosure 12 while orally describing the displayed merchandise within the display enclosure 12 by the audio apparatus 90.

The display enclosure 12 has a pair of transparent mirrors 14 and 16, which form the front and back walls. The transparent mirrors 14 and 16 enable the consumer to observe how the clothing merchandise 102 looks when worn by the consumer, after the audio-visual cycle of operation has been completed, as well as enhancing the aesthetic appearance of the display device 10.

The display enclosure 12 is divided into three compartments 20, 22 and 24, each having two of their sides formed by the transparent mirrors 14 and 16. Before a cycle of operation begins, the compartments 20, 22 and 24 are not visible to the consumer when viewing the display enclosure 12, but instead, the consumer's image appears on either the transparent mirror 14 or the transparent mirror 16, depending upon the position of the consumer. The compartments 20, 22 and 24 enable the display enclosure 12 to separately display pictorial representations of merchandise.

Within the compartments 20, 22 and 24 and affixed by suitable means to the back of the transparent mirror 14 are the pictures 30, 32 and 34, respectively. Within the compartments 20, 22 and 24 and affixed by suitable means to the back of one-way mirror 16 are the pictures 36, 38 and 40, respectively. These pictures depict the merchandise being described by the display device 10. The pictures 30 and 36 display the same piece of merchandise and may be the same picture which is also true of the pictures 32 and 38 and the pictures 34 and 40.

The compartments 20, 22 and 24 are separated by a pair of suitable partitions 26 and 28. Separation of compartments is necessary to enable the consumer to concentrate on the pictures displayed within one particular compartment. Within the compartment 20 and rigidly attached to the partition 26 are a pair of electrical sockets 42 and 44. Screwed into the electrical sockets 42 and 44 are a pair of light bulbs 43 and 45, respectively, which provide illumination within the compartment 20. When the light bulbs 43 and 45 are actuated and the compartment 20 is illuminated, the picture 30 is visible within the display enclosure 12 to the consumer in front of the transparent mirror 14. Also, when the compartment 20 is illuminated, the picture 36 is visible within the display enclosure 12 to the consumer in front of the transparent mirror 16. Also attached to the partition 26 and within the compartments 22 and 24 are electrical sockets 46 and 48, respectively, which have light bulbs 47 and 49, respectively, screwed therein. As each compartment is illuminated in sequence, the pictures within each compartment become visible to the viewing consumer.

In the bottom of the display enclosure 12 is a compartment 18 in which the timer apparatus 50 and the audio apparatus 90 are located. The timer apparatus 50 operates the system employing the present invention by sequentially regulating the illumination of the compartments within the display enclosure 12 and activating the audio apparatus 90 which enables an oral description to be given the consumer of each of the pictorial representations within the compartments.

Figure 3:
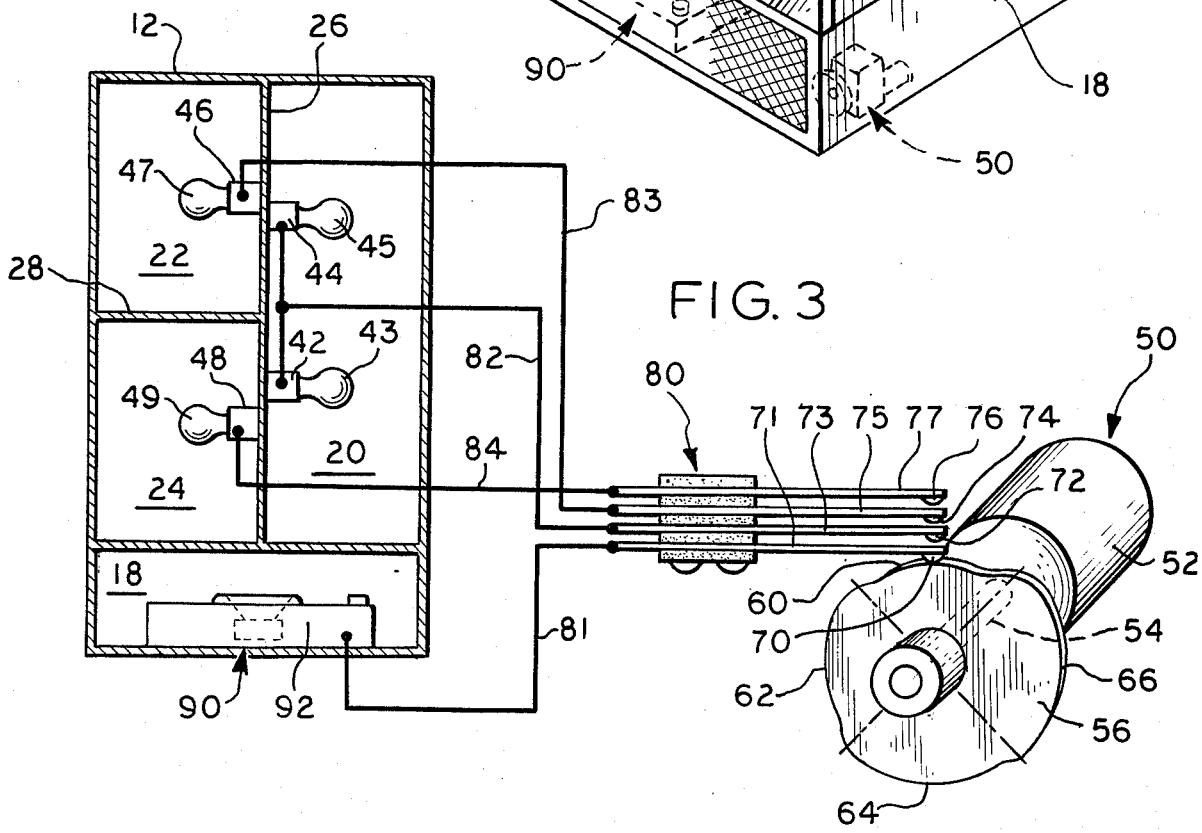
FIG. 3 is a schematic view of the audio apparatus which provides the oral descriptions and the timer apparatus which regulates the audio-visual cycle of the present invention.

Referring now to FIG. 3, the timer apparatus 50 will be more fully described. The timer apparatus 50 may be any device for controlling the sequential operation of a plurality of electrical components, the selection of which would be within the ordinary skill of one in the art. The timer apparatus 50 in this embodiment is comprised of a motor 52, a cam 56 and a switching apparatus 80. The motor 52 is an electrically driven variable speed device which has a shaft 54 rigidly connected to it. On the opposite end of the shaft 54 from its connection with the motor 52 is the cam 56 which is a flat disk with a plurality of actuating surfaces 60, 62, 64 and 66 on the perimeter thereof. As the motor 52 turns the shaft 54 and the cam 56 in a clockwise direction, the actuating surface 60 contacts a disk 70 attached to a switch 71 which is connected to the switching apparatus 80 of which the function and description will be described more fully hereinafter. When the actuating surface 60 is contacting the disk 70 attached to the switch 71, none of the compartments in the display enclosure 12 are illuminated. As the cam 56 further totates, the actuating surface 62 contacts the disk 70 attached to the switch 71 which in turn contacts a disk 72 attached to a switch 73 which is connected to the switching apparatus 80. At this point, the switching apparatus 80 actuates the illumination apparatus within the compartment 20 in the display enclosure 12. A consumer viewing the display enclosure 12 on either the transparent mirror 14 or 16 will observe either the picture 30 or 36 located within the compartment 20. The compartments 22 and 24 are not illuminated and the consumer's image will appear on either of the transparent mirrors 14 or 16 adjacent to the compartments 22 and 24.

As the cam further rotates, the actuating surface 64 contacts the disk 70 attached to the switch 71 which in turn contacts the disk 72 attached to the switch 73, which in turn contacts a disk 74 which is attached to a switch 75 which is connected to the switching apparatus 80. At this point, the switching apparatus 80 will actuate the illumination apparatus within the compartment 22 and now both compartments 20 and 22 are illuminated. A consumer viewing the display enclosure 12 on either the transparent mirror 14 or 16 will observe either of the pictures 30 and 32 or pictures 36 and 38 within the compartments 20 and 22. The compartment 24 is not illuminated and the consumer's image will appear on either the transparent mirrors 14 or 16 adjacent to the compartment 24.

When the cam 56 rotates sufficiently to cause the actuating surface 66 to contact the disk 70 attached to the switch 71 which in turn contacts the disks 72 and 74 and a disk 76, respectively attached to the switches 73 and 75 and a switch 77 which is connected to the switching apparatus 80, the compartment 24 is illuminated. At this point, all the compartments are illuminated and display the pictures 30, 32 and 34 on the transparent mirror 14 and display the pictures 36, 38 and 40 on the transparent mirror 16. At this time, a consumer will not be able to see his image on either of the transparent mirrors 14 or 16 adjacent to any compartment.

As the cam 56 rotates through a complete cycle of operation and again contacts the actuating surface 60, only the disk 70 attached to the switch 71 connected to the switching apparatus 80 will be in contact with the cam 56. There will be no illumination within the display enclosure 12 and hence the consumer will again see his image on either of the transparent mirrors 14 or 16 adjacent to the compartments 20, 22 and 24.

The switching apparatus 80 will now be more fully described. The switching apparatus 80 is an electrical device which causes the enumerated electrical sockets 42, 44, 46 and 48 to be supplied with electricity in a predetermined sequence. In this embodiment, the compartments 20, 22 and 24, wherein the electrical sockets 42, 44, 46 and 48 are located, will be illuminated in that order. The switching apparatus 80 has a plurality of electrical cords 82, 83 and 84 which sequentially supply electricity to the electrical sockets 42, 44, 46 and 48. The electrical sockets 42 and 44 are simultaneously supplied electricity by the electrical cord 82.

The switching apparatus 80 also regulates the operation of the audio apparatus 90. The function of the audio apparatus 90 is to provide an oral description of the accompanying pictures located within each compartment and the actual clothing merchandise 102 hanging on the clothing rack 100. The audio apparatus 90 primarily consists of a tape recorder 92 which is a single-loop recording device. The tape recorder 92 has a recording tape (not shown) and electronically embedded thereon is an inaudible sink (not shown). When the tape recorder 92 is electronically actuated by the switching apparatus 80 through a connecting cord 81, the recording tape begins to cycle and produce audible sounds through a speaker 94. When the recording tape cycles to the inaudible sink, the recording tape stops until signalled to begin again by the switching apparatus 80. The time in which the tape takes to cycle through one oral presentation is less than the time it takes the cam 56 to rotate through a complete operational cycle. Thus, there is a period of time when the audio apparatus 90 is not orally describing the merchandise shown in the pictures located within the display enclosure 12. This absence of oral presentation also coincides with the portion in the cycle of the cam 56 wherein none of the compartments are illuminated and the consumer may see his own image on one of the one-way mirrors 14 or 16. At this point, the consumer may try on the clothing merchandise 102 and determine how it fits and looks by utilization of the transparent mirrors 14 or 16.

In response to the signal from the timer apparatus 50, the switching apparatus 80 regulates the supply of electricity to the electrical sockets 42, 44, 46 and 48 and to the audio apparatus 90. When the actuating surface 60 on the cam 56 is contacting the disk 70 attached to the switch 71, the switching apparatus 80 supplies electricity neither to the electrical sockets 42, 44, 46 and 48 nor to the audio apparatus 90. The display enclosure 12 is not illuminated and the audio apparatus 90 has not been actuated. On the other hand, when the actuating surface 66 is contacting the disk 70 attached to the switch 71, the switching apparatus supplies electricity to the electrical sockets 42, 44, 46 and 48 and to the audio apparatus 90. The display enclosure 12 is now fully illuminated and the audio apparatus 90 has been actuated.

In summary, the display device 10 functions in the following manner. The motor 52 turns the shaft 54 which in turn causes the cam 56 to rotate in a clockwise motion. While the actuating surface 60 is contacting the disk 70 attached to the switch 71 connected to the switching apparatus 80, no illumination is provided in the display enclosure 12 and specifically within the compartments 20, 22 and 24. Furthermore, the audio apparatus 90 has not been actuated.

When the cam 56 rotates sufficiently to cause the actuating surface 62 to contact the disk 70 attached to the switch 71 which in turn contacts the disk 72 attached to the switch 73, the switching apparatus 80 supplies electricity via the electrical cord 82 to the electrical sockets 72 and 44 which in turn cause the light bulbs 43 and 45 to illuminate the compartment 20. Concurrently, the switching apparatus 80 electronically signals the tape recorder 92 via the cord 81 to move the recording tape past the inaudible sink electronically embedded on the tape. The compartment 20 is illuminated so as to allow the consumer viewing the display enclosure 12 to see the picture 30 and the picture 36. Further, the compartments 22 and 24 are not illuminated and the consumer's image may be seen on either of the transparent mirrors 12 or 13, adjacent to those compartments.

As the cam 56 rotates further, the actuating surface 64 contacts the disks 70, 72 and 74 attached to the switches 71, 73 and 75 connected to the switching apparatus 80. At that point, the switching apparatus 80 supplies electricity via the electrical cord 83 to the electrical socket 46 which causes the light bulb 47 to illuminate the compartment 22. The tape on the tape recorder 92 via the speaker 94 is now orally explaining the pictures 32 and 38 within the compartment 22. Sequentially, as the cam 56 rotates through the actuating surface 66, the compartment 24 is illuminated and the pictures 34 and 40 are orally described by the tape recorder 92.

When the cam 56 rotates sufficiently and the actuating surface 60 again contacts the disc 70 attached to the switch 71, the switching apparatus 80 discontinues sending electricity to the electrical sockets 42, 44, 46 and 48 and the display enclosure 12 is no longer illuminated. The tape recorder 92 has already been programmed to reach the inaudible sink on the recording tape and thus no audible sounds are heard. The display enclosure 12 is unilluminated from within and the cam 56 has completely cycled. The consumer may now near the clothing merchandise 102 and observe how it looks in the transparent mirrors 14 and 16.

The audio-visual display device hereinbefore described has two transparent mirror sides. It should be noted that the display device could have a single one-way mirror which completely encircles the compartments or a display device could be built wherein a plurality of four transparent mirror sides are envisioned.

While the embodiment described herein is at present considered to be preferred, it is understood that various modifications and improvements may be made therein, and it is intended to cover in the appended claims all such modifications and improvements as fall within the true spirit and scope of the invention.

What is desired to be claimed and secured by Letters Patent of the United States is:

1. A display device for audio and visual merchandise promotion comprising:

a. a display enclosure comprising:

1. at least first and second compartments each having an illumination means therein;
2. at least one wall forming a side of the first and second compartments, the wall composed of a transparent mirror having the characteristic of reflecting visible light radiation when the illumination means is not activated and transmitting visible light radiation when the illumination means is activated;

3. at least one pictorial representation of merchandise on the inside of the wall;

b. an audio means including at least one audio tape; and c. a timer means for regulating a cyclic sequential actuation of the illumination means in each of the first and second compartments and the actuation of the audio means said time means adapted to produce a cycle including a period of activation of said illumination means wherein said transparent mirror transmits visible light and said pictorial representation is observable through said transparent mirror and a period without activation of said illumination means wherein said transparent mirror reflects visible light and said pictorial representation is not observable through said transparent mirror.

2. The display device of claim 1 wherein the illumination means and the audio means are activated simultaneously.

3. The display device of claim 1 wherein the first and second compartments are illuminated sequentially in a predetermined time period.

4. The display device of claim 1 further including a clothing rack adapted to support merchandise being displayed.

5. The display device of claim 1 wherein the timer means includes a motor and a rotatable cam drivingly connected to the motor, the cam having at least first and second actuating surfaces, the first actuating surface contacting a frist switch which actuates the illumination means in the first compartment and a first audio tape, the motor rotating the cam until the second actuating surface contacts the first switch which causes the first switch to contact a second switch which actuates the illumination means in the second compartment and a second audio tape, the cam rotating until the first and second actuating surfaces disengage from the first and second switch and the illumination means and audio means are de-energized.

6. A display device for audio and visual merchandise promotion comprising:

a. a display enclosure comprising:

1. at least first and second compartments each having an illumination means therein;

2. front and rear walls forming sides of the first and second compartments, said walls composed of a transparent mirror having the characteristic of reflecting visible light radiation when the illumination means is not activated and transmitting visible light radiation when the illumination means is activated;

3. a pictorial representation of merchandise on the inside of the wall;

b. an audio means including at least one audio tape; and c. a timer means for regulating a cyclic sequential actuation of the illumination means in each of the first and second compartments and the actuation of the audio means said timer means adapted to produce a cycle including a period of activation of said illumination means wherein said transparent mirror transmits visible light and said pictorial representation is observable through said transparent mirror and a period without activation of said illumination means wherein said transparent mirror reflects visible light and said pictorial representation is not observable through said transparent mirror.

7. The display device of claim 6 wherein the illumination means and the audio means are activated simultaneously.

8. The display device of claim 6 wherein the first and second compartments are illuminated sequentially in a predetermined time period.

9. The display device of claim 6 further including a clothing rack adapted to support merchandise being displayed.

* * * * *

UNITED STATES PATENT AND TRADEMARK OFFICE

CERTIFICATE OF CORRECTION

PATENT NO. : 4,035,941

DATED : July 19, 1977

INVENTOR(S) : John F. Deffner

It is certified that error appears in the above-identified patent and that said Letters Patent are hereby corrected as shown below:

Column 1, line 52; Column 3, line 38; Column 5, line 46, and Column 6, lines 49-50, for the term "one-way", each occurrence, should read - - transparent - -. Column 4, line 27, the word "totates" should read - - rotates - -. Column 6, line 21, the reference numerals "12 or 13" should read - - 14 or 16 - -; Column 6, line 44, the word "near" should read - - wear - -. Claim 5, line 5, "frist" should read - - first - -.

Signed and Sealed this

*Twenty-fifth* Day of *April 1978*

[SEAL]

*Attest:*

RUTH C. MASON
*Attesting Officer*

LUTRELLE F. PARKER
*Acting Commissioner of Patents and Trademarks*